United States Patent [19]

Huvers

[11] 4,087,919

[45] May 9, 1978

[54] RATE INTEGRATING GYROSCOPIC AIMING METHOD AND DEVICE THEREFOR

[75] Inventor: Marius E. Huvers, Ste-Therese, Canada

[73] Assignee: Canadair Limited, Montreal, Canada

[21] Appl. No.: 598,134

[22] Filed: Jul. 22, 1975

[51] Int. Cl.[2] ..... G01C 19/36

[52] U.S. Cl. ..... 33/301; 33/275 G; 33/324

[58] Field of Search ..... 33/275 G, 324, 318, 33/321, 301

[56] References Cited

U.S. PATENT DOCUMENTS

| | | | |
|---|---|---|---|
| 2,801,542 | 8/1957 | Wendt | 33/318 X |
| 3,561,129 | 2/1971 | Johnston | 33/324 |
| 3,898,744 | 8/1975 | Johnston | 33/324 |

*Primary Examiner*—William D. Martin

*Attorney, Agent, or Firm*—A. Lebrun

[57] ABSTRACT

A gyroscopic azimuth aiming concept adapted to aim a drone or missile at the launch site but also to aim other military and non-military equipment. This concept is characterized by its use of a conventional rate integrating gyroscope to both measure the aiming error, which results from an approximate initial aiming done with a magnetic compass, and to effect the correction of the aiming error without the use of surveying or optical sighting instrument. This invention defines the method of measuring the aiming error including toppling the gyroscope to displace the input axis thereof from horizontal to vertical in order to provide a measure of the required angular correction. This invention also defines a device wherein a conventional rate integrating gyroscope is pivotally mounted to allow rotation of 180° in azimuth between a first and a second measurements of the rotation of the input axis direction and to allow toppling of the input axis as above mentioned.

10 Claims, 4 Drawing Figures

RATE INTEGRATING GYROSCOPIC AIMING METHOD AND DEVICE THEREFOR

This invention relates to gyroscopic aiming of an object such as a drone, missile, cannon, or other military or non-military equipment. More particularly, this invention relates to a method and a device for gyroscopic aiming of the type using a rate integrating gyroscope.

The aiming of an object such as a drone, missile, or cannon requires determination of an azimuth direction with respect to an accepted azimuth reference line. For instance, either the magnetic north, the grid north, or the geographic north may be used as accepted azimuth reference line.

According to the present technique, azimuth alignment of a missile or the like is done by a survey crew which, by ground surveying on the launch site, determines a reference bearing and marks it on the ground such as by stakes. The launcher is then aligned relative to the stakes by optical sighting instrument.

The aforementioned surveying method is found relatively time consuming and unsuitable for reliable and fast operation as required for launching of a missile. There are also other methods for azimuth alignment such as magnetic astronomical, and by gyro compass, and none of these other methods is found very convenient.

The present invention essentially uses a conventional rate integrating gyroscope unit which is readily available off-the-shelf from different companies. One such rate integrating gyroscope is marketed by Northrop Corporation in the G1–G6 series as defined in their sale brochure 1974/3K.

It is a general object of the present invention to provide gyroscopic aiming which obviates the aforementioned disadvantages and more particularly, which obviates the disadvantages associated to the presently used ground surveying method.

It is another general object of the present invention to provide gyroscopic aiming which advantageously uses a conventional rate integrating gyroscope unit for both, the measurement of the aiming error and the angular correction of the misalignment or aiming error by appropriate rotation or slewing of the carrier or launcher.

It is another object of the present invention to provide a gyroscopic aiming method and device which are simple, avoid the need for accurate optical sighting and produce rapid results with a minimum of exposure to enemy detection at the launch site.

The above and other objects and advantages of the present invention will be better understood with the following detailed description of a preferred embodiment thereof which is illustrated, by way of example, in the accompanying drawings; in which.

Figure 1:
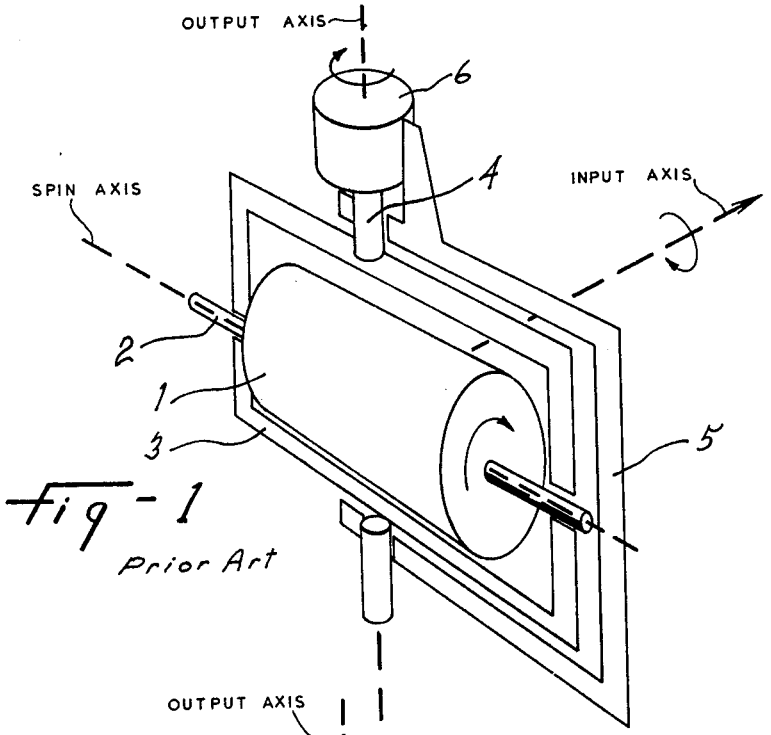
Fig-1 Prior Art
FIG. 1 is a schematic view in perspective of a conventional rate integrating gyroscope.

A conventional rate integrating gyroscope as known in the prior art and schematically shown in FIG. 1 includes a spinning rotor having a shaft 2 rotatable therewith on gas bearings, in a gimbal 3. The latter in fact constitutes an hermetic housing filled with a rare gas in which the rotor 1 runs. The rotor shaft 2 defines the spin axis of the spinning rotor 1. The gimbal housing 3 is pivotally supported by shaft 4 engaged in appropriate bearings, not shown, such as either gas or ball bearings fixed to the outer hermetically sealed housing 5 schematically shown in FIGS. 1 and 2. A torque motor, signal generator or pick-off, and damping arrangement of conventional construction, schematically represented by the outlined unit 6, is connected to the shaft 4 of the gimbal housing 3 to perform the open or closed loop measuring of the input rate and closed loop zeroing of the output of the pick-off. These functions and the associated hardware are known in the art and need not be defined herein. Conventionally, the gimbal housing 3 is floated in a fluid contained in the outer housing 5. As aforementioned, the rate integrating gyroscope formed of the outer housing 5 and the enclosures, is sold off-the-shelf as a complete conventional unit.

OPERATION OF A CONVENTIONAL RATE INTEGRATING GYROSCOPE UNIT

Figure 2:
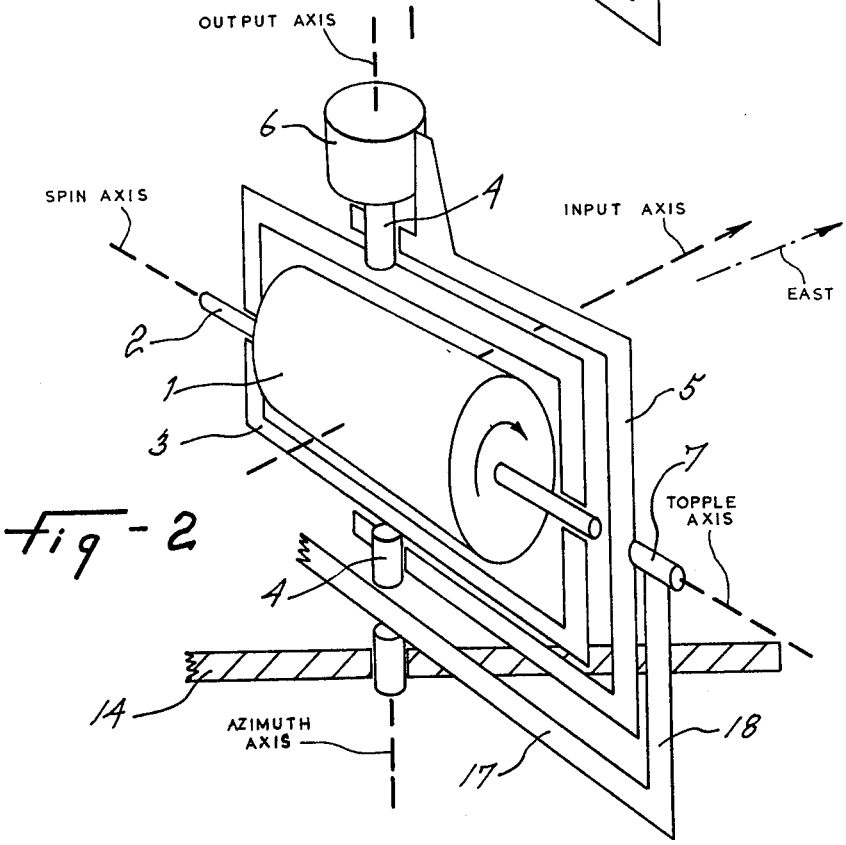
FIG. 2 is a schematic view in perspective of a rate integrating gyroscope aiming device according to the present invention and including the rate integrating gyroscope of FIG. 1.

The relative position between the spin axis, the input axis, and the output axis is shown in FIGS. 1 and 2. When the outer housing 5 is rotated with respect to inertial space around an axis parallel with the input axis with an input rate e.g. by earth rotation, a precession torque is generated around the output axis. As known in the art, this precession torque is the product of the input rate, the spinning speed, and the polar moment of inertia of the spinning rotor 1 relative to its spin axis.

A conventional rate integrating gyroscope essentially has a heavy fluid damping of the rotation of the output shaft 4; hence the output shaft rotates at an angular rate which is proportional to the precession torque and which is also proportional to the input rate if both the spinning speed and the polar moment of inertia are constant; or in other words, if the angular momentum of the rotor 1 is constant. The ratio of the output rate over the input rate is called the gyro gain and is usually between 0.1 and 200. In the present invention, a gain of 25 is preferred.

Because the rate of rotation of the output shaft 4 is proportional to the sensed input rate, the integral of the output shaft rate is the output shaft rotation angle as sensed and measured by the signal generator or pick-off. Due to the fixed gyroscope gain this output shaft rotation also produces a measure of the amount of input rotation from the initial zero position. This initial zero position has initially been preset when the output shaft angle was brought to its zero position by closing an electrical servo loop between the torque motor and the signal generator. As soon as this servo loop is removed or opened the gyroscopic unit starts to integrate the output rate.

This explains the name rate integrating gyroscope. This mode is referred to as internally integrating because the integration is internally done in the gyroscope unit. If this zeroing servo loop stays closed then this gyroscopic unit does not act as a rate integrating gyroscope but as a rate gyroscope. Consequently, the non-integrating rate gyroscope has an output signal which is then proportional to the sensed input rate and in order to keep the output shaft near its zero position the signal generator has to provide an electrical current to the torque motor such that the generated motor torque is equal and opposite to the precession torque resulting from the sensed input rate. Hence the output current provided by the signal generator is effectively proportional to the sensed input rate. If this output rate signal is integrated externally of the gyroscopic unit then this mode is referred to as externally integrating.

The general operation of a conventional rate integrating gyroscope unit has so far been explained. This aforedescribed operation of the rate integrating gyroscope will now be defined as used with a specific positioning of the axes of the gyroscope according to the present invention.

In the gyroscopic aiming device according to the present invention, the output axis is placed vertical and the spin and input axes basically horizontal, as shown in FIGS. 1 and 2. To simplify and ease understanding, let us assume that the aiming device of the present invention and its gyroscope are located on the equator with the input axis approximately pointing East with an East pointing error B within preferably less than 5° with respect to the East direction. The earth rotation rate has then an input component in the input axis direction which is a product of this earth rotation rate and the sine of the aforementioned East pointing error.

Integration of the resulting rotation rate of the output shaft is allowed for say 60 seconds, either internally or externally of the gyroscope as aforedescribed, this provides the amount of rotation of the output shaft 4 from its initial zero position when the internal integration is used. The zero rotation position of the output shaft is obtained prior to the 60-second measurement by closing a high gain servo loop which can be included in the gyroscope unit between the pick-off and the torque motor of the unit 6 to drive the output shaft 4 to zero. When external integration is used, the pick-off and torque motor are continuously in a high gain closed loop mode and the output signal of the rate integrating gyroscope porportionally represents the sensed input rate. The external integration provides the angular deviation of the input axis direction from its initial zero position.

The aforementioned vertical positioning of the output axis of the rate integrating gyroscope unit advantageously defines a non g-sensitive operation and hence avoids relatively large g-sensitive drift rates as are commonly produced by unbalance in the unit. However, in this defined position, the earth rotation produces a secondary effect which changes the initial Eastpointing error B of the input axis direction. The measured value of the output shaft rotation during one 60-second period includes this secondary effect. If two periods of 60 second measurements are taken, one with the input axis direction 180° different from the other, then these secondary effects have opposite signs and cancel each other when summed.

By calculations we can demonstrate that the gyroscope unit has high sensitivity. For instance, for an earth rotation of 0.25° during 60 seconds, the component of rotation of the input axis is 0.02179° and the measured output shaft rotation is 0.545 if the initial East pointing error is plus or minus 5° and the gyro gain is 25.

It was assumed for simplicity that the location of the carrier or launcher was at the equator; however for any other latitude the horizontal input axis of the rate integrating gyroscope unit senses an input rate which is also a function of the cosine of the latitude. The rate integrating gyroscope in the non-equatorial location provides an output signal which is then proportional to the sine of the East pointing error B to the cosine of the latitude.

STRUCTURE OF THE RATE INTEGRATING GYROSCOPE AIMING DEVICE

Figure 3:
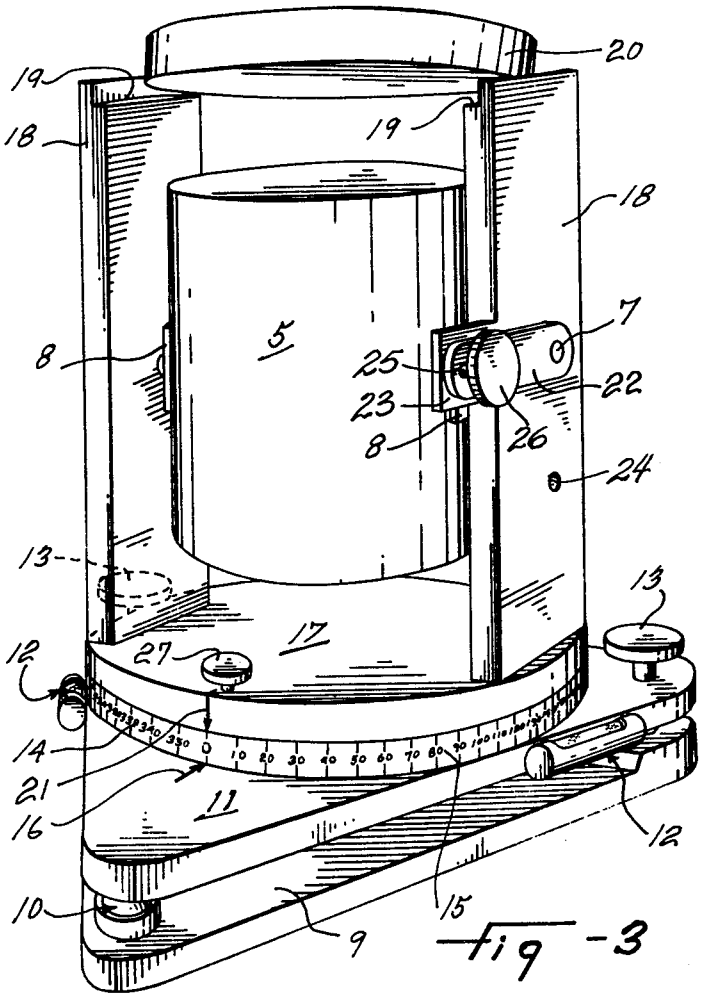
FIG. 3, is a perspective view of a specific embodiment of the rate integrating gyroscope aiming device of FIG. 2.

The complete rate integrating briefly aforedescribed gyroscopic aiming device according to the present invention includes the gyroscope unit, as represented by the outer housing 5' in FIG. 3. The illustrated embodiment of the present invention is illustrated in FIGS. 2 and 3. This embodiment will now be defined in details using unprimed numerals to refer to FIG. 2 and primed numerals to refer to FIG. 3. A pair of pivot pins, 7' are secured on opposite sides respectively of the outer housing, 5' and in diametrical alignment by mounting plates 8.

The rate integrating gyroscopic aiming device according to the present invention includes a mounting plate 9 which can be of any convenient form for suitable fixing thereof to a carrier such as a cannon, drone, missile, or other aimable equipment. A ball and socket pivot connection 10 interconnects a baseplate 11 and the mounting plate 9. The baseplate 11 is of triangular outline and has a pair of spirit levels 12 fixed thereto along two side edges thereof such as to extend lengthwise along two intersecting lines. A pair of level adjustment screws are screwed through the baseplate 11 substantially in alignment with these intersecting lines respectively.

A disk, 14' is rotatively connected to the baseplate 11 to form a turntable rotatable about an operatively vertical turntable axis. The cicular periphery of the turntable, 14' is provided with an azimuth angle scale 15 preferably extending 360° around the turntable. The marking of the scale 15 may be in degrees as shown, in mils, or both, for the convenience of the user. An index mark 16 is provided on the baseplate 11 in alignment with the longitudinal reference axis of the object to be aimed.

A support is pivoted on the turntable, 14' about a vertical axis which preferably coincides with the vertical turntable axis. This support includes a base portion, 17' of circular plan outline and laterally spaced apart leg portions, 18' upwardly projecting from the base portion, 17'. The leg portions 18 are longer than the axial length of the outer housing, 5' and the pivot pins, 7' are positioned into the leg portions, 18' to allow 90° toppling of the gyroscope unit between the latter. The pivot pins, 7' thus define a topple axis for the gyroscope unit which basically extends in the direction of the spin axis of the latter. The upper end of each leg portion, 18' is notched at 19 to cooperatively form a circular seat for a magnetic compass 20 of any conventional and ordinary type. A reference mark 21 is provided on the circumference of the base portion, 17'. As shown in FIG. 3, one pivot pin, 7' projects outwardly from the corresponding leg portion, 18' and has an arm 22 rigidly secured thereto for rotation therewith and with the gyroscope unit about the topple axis. A lug 23 is fixed to the above corresponding leg portion, 18'. A hole 24 is provided through this leg portion and another hole 25 is provided through the lug or projection 23. A spring biased pin 26 is mounted on the arm 22 to selectively engage in either of the two holes 24 and 25. These holes 24 and 25 and the arm 22 are angularly positioned relative to each other and to the input axis of the gyroscope unit whereby the input axis may be selectively set either horizontal or vertical by toppling of the gyroscope unit about the afore described topple axis and corresponding insertion of the pin 26 in the corresponding hole.

A detent system, not shown, is provided between the baseplate 11 and the turntable disk, 14'. This detent system may be of any known and appropriate type, such as of the spring loaded ball or plunger type, but must include a plurality of evenly spaced apart detent positions around the turntable axis whereby the latter may be set in azimuth in any one of these detent positions. In this embodiment of the invention, the detent positions between the turntable and the baseplate have been accurately positioned at 2° intervals. Other preferably round figure intervals could be used instead, such as 50 mils, for instance when the scale 15 is in mils.

Another detent system this time interconnects the base portion, 17' of the support to the turntable, 14'. This other detent system includes a pin 27 extending through the base portion, 17' and removably engageable into either one of two cavities or holes in the turntable. These two cavities or holes, not shown, are positioned exactly 180° apart relative to the pivot axis of the support and thus define a pair of diametrically opposite detent positions relative to this axis.

It must be understood that the exact nature and cooperative relationship of the baseplate, the turntable, and the support may be greatly varied and still remain within the principle of the present invention as long as there are provided two 180 degree apart detent positions and a plurality of evenly spaced apart detent positions.

GYROSCOPIC AIMING AND AZIMUTH CORRECTION

Figure 4:
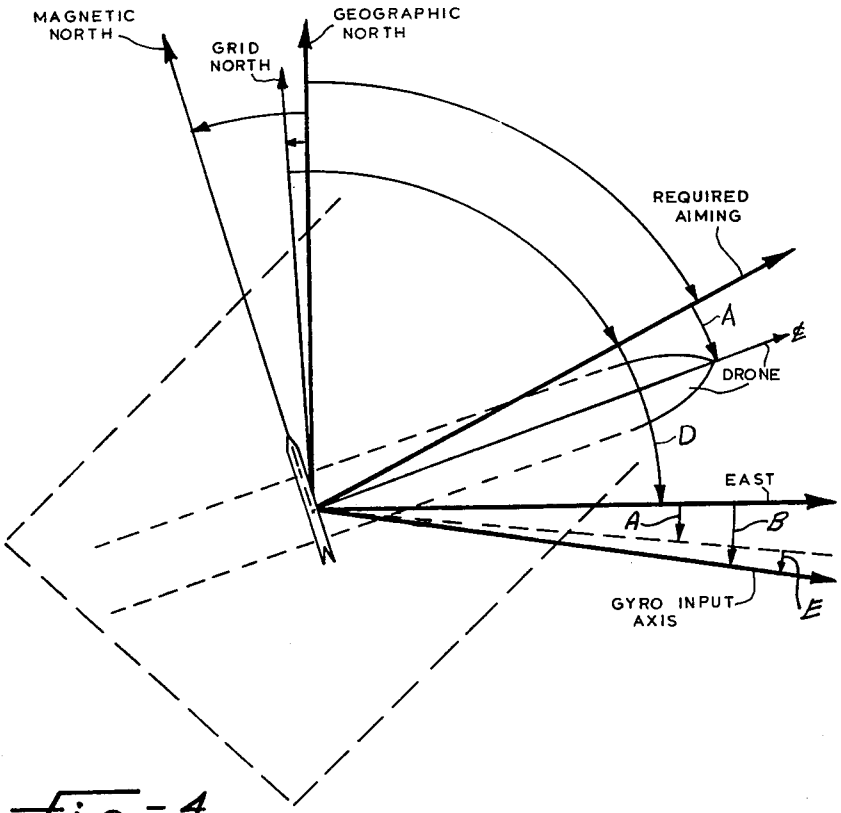
FIG. 4 is a plan view of the launch site with the associated angles used to obtain the aiming error.

Reference should now be made to FIG. 4 which is a sketch in plan view of a launch area with the associated angles an azimuth directions.

The launcher with the aiming device secured thereto is first slewed to the desired or required azimuth direction using a magnetic compass, such as the compass 20 optionally seated on the leg portions, 18'. Due to the inherent inaccuracy of the magnetic compass, there results a probable aiming error A. The baseplate 11 is then levelled and the gyroscope housing 5 placed and locked with the output axis in the vertical position. The turntable, 14' is then rotated to align the input axis of the gyroscopic unit in the East direction. This is done by detent setting the turntable in a detent position of the plurality of detent positions which is nearest the required azimuth angle D between the East direction and the required aiming direction. Since these detent positions are spaced apart some angular distance, there results an approximate setting and a corresponding detent setting error E. The latter may not be more than half of the above mentioned angular interval; that is, plus or minus 1° for 2° intervals. The input axis of the gyroscope is now an angle B or A+E off the East direction.

The output pick-off of the gyroscope is brought a first time to zero by placing the same in a high gain closed loop mode with the associated torque motor.

The rate integrating gyroscope is then allowed to produce integration of the earth rotation rate component due to error B from the East direction either internally, by placing it in the open loop mode, or externally by placing it in the closed loop mode and in connection with an external integrator. This first integration is allowed to last 60 seconds. This provides a first measurement of the output shaft rotation which is then stored.

The detent system which defines two 180° apart detent positions is then used by actuation of the pin 27 to rotate the gyroscope unit exactly 180° in azimuth. This 180° rotation serves to take two measurements which will result in cancellation of the bias and unbalance errors of the gyroscope.

A second integration of the aforementioned earth rotation input rate is allowed for the same period of 60 seconds and in the same selected mode as for the first integration. The second measurement of the output shaft rotation thus produced is also stored.

At this point, the East pointing error B of the input axis and the aiming error A of the carrier or launcher are electronically or otherwise calculated by substracting the first and the second measured integrated values one from the other and thereafter correcting for the known detent setting error and for the local latitude. The result of this calculation is the value of the aiming error A.

An advantageous feature of the present invention consists in allowing correction of the azimuth aiming of the carrier, drone, or the like without having to use the unsatisfactory surveying method. This is done by measuring the actual carrier rotation required for correcting the aiming error A by means of the same rate integrating gyroscope unit and substracting it from the calculated aiming error A. Thus, the aiming device is used for both measuring the aiming error and providing the corresponding correction in the azimuth aiming of the carrier.

To effect the above correction the rate integrating gyroscope unit is toppled exactly 90° about the topple axis defined by the pivot pins, 7'. The input axis thus becomes vertical and the gyroscope thus measures the rotation in a horizontal plane. the gyroscope is now operated in the closed loop mode to avoid excessive rotation of the output shaft which would otherwise result due to the gyroscope gain of 25. Since the input axis is now vertical and the gyroscope measures the rotation in a horizontal plane, upon corrective rotation of the launcher or carrier in azimuth, the pick-off measures the angular correction rate thus imparted to the gyroscope after an external integration, the measured angular correction rate is compared with the required correction to cancel the azimuth aiming error A. This comparison may be done by comparison in a millivolt meter such as by causing the needle thereof to move toward a zero center position. The aforementioned electronic calculations may be performed by any auxiliary calculating equipment which is readily available in the appropriate art and whose details of construction do not fall within the scope of the present invention.

The technique of comparison using a millivoltmeter is well known. It essentially consists in comparing two electrical signals in a voltmeter and to effect correction until the corresponding signal equals the other signal representing the needed correction.

What I claim is:

1. A rate integrating gyroscopic aiming device comprising a baseplate, levelling means operatively connected to said baseplate and constructed and arranged to level the latter relative to a carrying surface, a rate integrating gyroscope unit including a rotor, a gimbal, and a housing, the gimbal rotatably carrying the rotor for rotation thereof about a spin axis, the housing pivotally carrying the gimbal for pivoting thereof about an output axis extending orthogonally to the spin axis, and a support pivotally carrying said rate integrating gyroscope housing about a topple axis extending basically in the same direction as said spin axis, and rotatably connected relative to the baseplate about an operatively vertical axis.

2. A rate integrating gyroscopic aiming device as defined in claim 1, further including a detent system operativerly connecting the support relative to the baseplate in either of two diametrically spaced apart detent positions one relative to the other.

3. A rate integrating gyroscopic aiming device as defined in claim 1, further including one detent system operatively connecting the support relative to the baseplate and defining a plurality of evenly spaced apart detent positions around the turntable axis for approximate detent setting of the input axis according to a required setting thereof in azimuth relative to the East direction.

4. A rate integrating gyroscopic aiming device as defined in claim 1, further including a turntable rotatable relative to the two bodies defined by the baseplate and said support, a first detent system selectively interconnecting the turntable and one of said bodies and defininf two diametrically spaced apart azimuth setting positions of the turntable and said one body relative to each other, and a second detent system interconnecting the turntable and the other of said bodies and defining a plurality of evenly spaced apart detent positions around the turntable axis for approximate detent setting of the input axis according to a required setting thereof in azimuth relative to the East direction.

5. A rate integrating gyroscopic aiming device as defined in claim 1, further including a detent selectively interconnecting the rate integrating gyroscope unit to the support in either of two orthogonally spaced apart positions of the gyroscope unit relative to the support and allowing selective setting of the output axis either vertical or horizontal by pivoting the gyroscope about the toppole axis.

6. A rate integrating gyroscopic aiming device as defined in claim 5, wherein a pair of pivots outwardly project from opposite sides of the rate integrating gyroscope in alignment with each other and are pivotally carried by the support thereby defining the topple axis.

7. A rate integrating gyroscopic aiming device comprising a mounting plate, a baseplate, a universal pivot connection joining the baseplate to the mounting plate, spirit levels secured to the baseplate. Levelling screws connected to the latter and engaging the mounting plate for level adjustment of the baseplate, a circular turntable rotatively connected to the baseplate and operatively defining an upright turntable axis, an azimuth angle scale provided along the periphery of the circular turntable, a first pointer provided on the baseplate in proximity to the azimuth angle scale, a support rotatively connected to the circular turntable for rotation about said operatively upright turntable axis, said support having a base portion and a pair of leg portions, with the latter projecting away from the base portion on the axially opposite side thereof relative to the turntable and in diametrically spaced apart relationship relative to the operatively upright turntable axis, the turntable having a first pair of cavities formed therein at diametrically opposite points relative to the operatively upright turntable axis, a first spring biased detent pin projecting through said base portion and selectively engageable in either of said cavities for selective setting of the support in either of two diametrically opposite directions relative to the turntable, a detent system interconnecting the turntable to the baseplate and defining a plurality of evenly spaced apart detent positions around the turntable axis for approximate detent setting of the input axis according to a required setting thereof in azimuth relative to the East direction, a rate integrating gyroscope unit, including a rotor defining a spin axis, a pair of pivot pins rigidly secured to the rate integrating gyroscope unit, and diametrically projecting therefrom in pivotal engagement with said leg portions respectively and basically in alignment with the spin axis of said rotor for toppling of the gyroscope unit about a topple axis defined by said pivot pins, an arm rigidly secured to one of said pivot pins and bodily pivotable therewith, a second pair of cavities provided on the leg portion corresponding to said one pivot pin and orthogonally spaced from each other relative to the topple axis and a second spring biased detent pin mounted onto said arm, selectively engageable into either cavity of said second pair of cavities, and positioned relative to the latter and the input axis around the topple axis whereby upon corresponding toppling of the rate integrating gyroscope unit about the topple axis, the input axis may be selectively positioned either horizontal or vertical.

8. An aiming method for a carrier comprising approximately aligning the carrier with a desired azimuth direction, providing a rate integrating gyroscope unit having a rotor, a gimbal, a housing and an output axis, positioning the rate integrating gyroscope unit with the output axis in the upright directon, approximately detent setting the input axis in azimuth relative to the East direction, producing one zeroing of the output of the pick-off of the gyroscope, allowing a first integration of the input rate of the rate integrating gyroscope unit for a fixed period of time to provide a first measurement of the output shaft rotation during the first period of time, rotating the rate integrating gyroscope unit exactly 180° about its upright output axis, producing another zeroing of the output of the pick-off of the gyroscope unit allowing a second integration of the input rate of the rate integrating gyroscope unit for the same fixed period of time to provide a second measurement of the output shaft rotation during the second fixed period of time, substracting one of said measurements from the other, correcting for local latitude and for any angular difference between the selected detent position and the required azimuth setting of the input axis introduced by the approximate detent setting of the latter, to define a measurement of the aiming error relative to the desired azimuth direction, toppling the rate integrating gyroscope unit exactly 90° about a topple axis basically extending in the direction of the spin axis, and rotating the carrier until a reading of the output of the pick-off indicates an azimuth correction of the carrier corresponding to said measurement of the aiming error.

9. An aiming method as defined in claim 8, wherein allowing the first and the second integrations of the input of the rate integrating gyroscope unit is done with the gyroscope in open loop mode, said one and another zeroing is done with the gyroscope in closed loop mode, and rotating the carrier is done with the gyroscope in closed loop mode, during integration externally of the rate integrating gyroscope unit.

10. An aiming method as defined in claim 9, wherein allowing the first and the second integrations of the input rate of the rate integrating gyroscope unit, said one and said another zeroing, and rotating the carrier are done with the gyroscope unit in closed loop mode and the integrations are done externally of the rate integrating gyroscope unit.

* * * * *